US005797308A

United States Patent [19]

Evans et al.

[11] Patent Number: 5,797,308

[45] Date of Patent: Aug. 25, 1998

[54] HOLE PUNCH HAVING A SLIDABLE SLIPPER AND ADJUSTABLE PUNCHES

[75] Inventors: Alfred J. Evans, Lake In the Hills; Balaji Kandasamy, Chicago, both of Ill.

[73] Assignee: ACCO Brands, Inc., Lincolnshire, Ill.

[21] Appl. No.: 697,934

[22] Filed: Sep. 3, 1996

Related U.S. Application Data

[62] Division of Ser. No. 516,022, Aug. 17, 1995.

[51] Int. Cl.[6] ..... B26F 1/02

[52] U.S. Cl. ..... 83/618; 83/167; 83/633

[58] Field of Search ..... 83/618, 167, 633, 83/634

[56] References Cited

U.S. PATENT DOCUMENTS

| | | | |
|---|---|---|---|
| 1,655,315 | 1/1928 | Finley | 83/618 X |
| 1,728,475 | 9/1929 | Cavill | 83/633 X |
| 1,870,055 | 8/1932 | Kline | 83/633 X |
| 2,001,161 | 5/1935 | Snyder et al. | 83/618 X |
| 2,137,716 | 11/1938 | Faas | 83/618 X |
| 2,244,320 | 6/1941 | Unger | 83/633 X |
| 2,244,660 | 6/1941 | Carpenter | 83/167 |
| 2,368,790 | 2/1945 | Unger | 83/167 X |
| 2,389,105 | 11/1945 | Kern | 83/167 |
| 2,474,344 | 6/1949 | Carpenter | 83/167 |
| 2,481,883 | 9/1949 | Semler | 83/633 X |
| 2,494,836 | 1/1950 | Segal | 83/167 |
| 2,534,094 | 12/1950 | Yerkes | 83/549 X |
| 3,176,570 | 4/1965 | Gaya | 83/633 X |
| 3,392,913 | 7/1968 | Neilsen | 83/633 X |
| 4,036,088 | 7/1977 | Ruskin | 83/167 |
| 4,656,907 | 4/1987 | Hymmen | 83/167 X |
| 4,688,457 | 8/1987 | Neilsen et al. | 83/633 X |
| 4,700,601 | 10/1987 | Simon | 83/687 |
| 4,713,995 | 12/1987 | Davi | 83/167 |

*Primary Examiner*—Maurina T. Rachuba
*Attorney, Agent, or Firm*—Pennie & Edmonds LLP

[57] ABSTRACT

A hand-operated punch with adjustable assembly punch units and a slipper to receive punched out discs in which the assembly units are adjustable from the bottom through an opening in the slipper. The punch includes a strengthening flap configuration and the assembly units slide but do not turn during adjustment.

6 Claims, 9 Drawing Sheets

HOLE PUNCH HAVING A SLIDABLE SLIPPER AND ADJUSTABLE PUNCHES

This is a division of application Ser. No. 08/516,022, filed Aug. 17, 1995.

BACKGROUND OF THE INVENTION

Punches with slidable slippers are old. Slippered punches with adjustable punch stations are also old but removal of the slipper is required to accomplish adjustment.

SUMMARY OF THE INVENTION

Broadly, the present invention is a slippered adjustable hand-operated punch with adjustment accomplished from the bottom of the punch without slipper removal. The flap handle is configured for added strength.

DESCRIPTION OF THE PREFERRED EMBODIMENT

Figure 1:
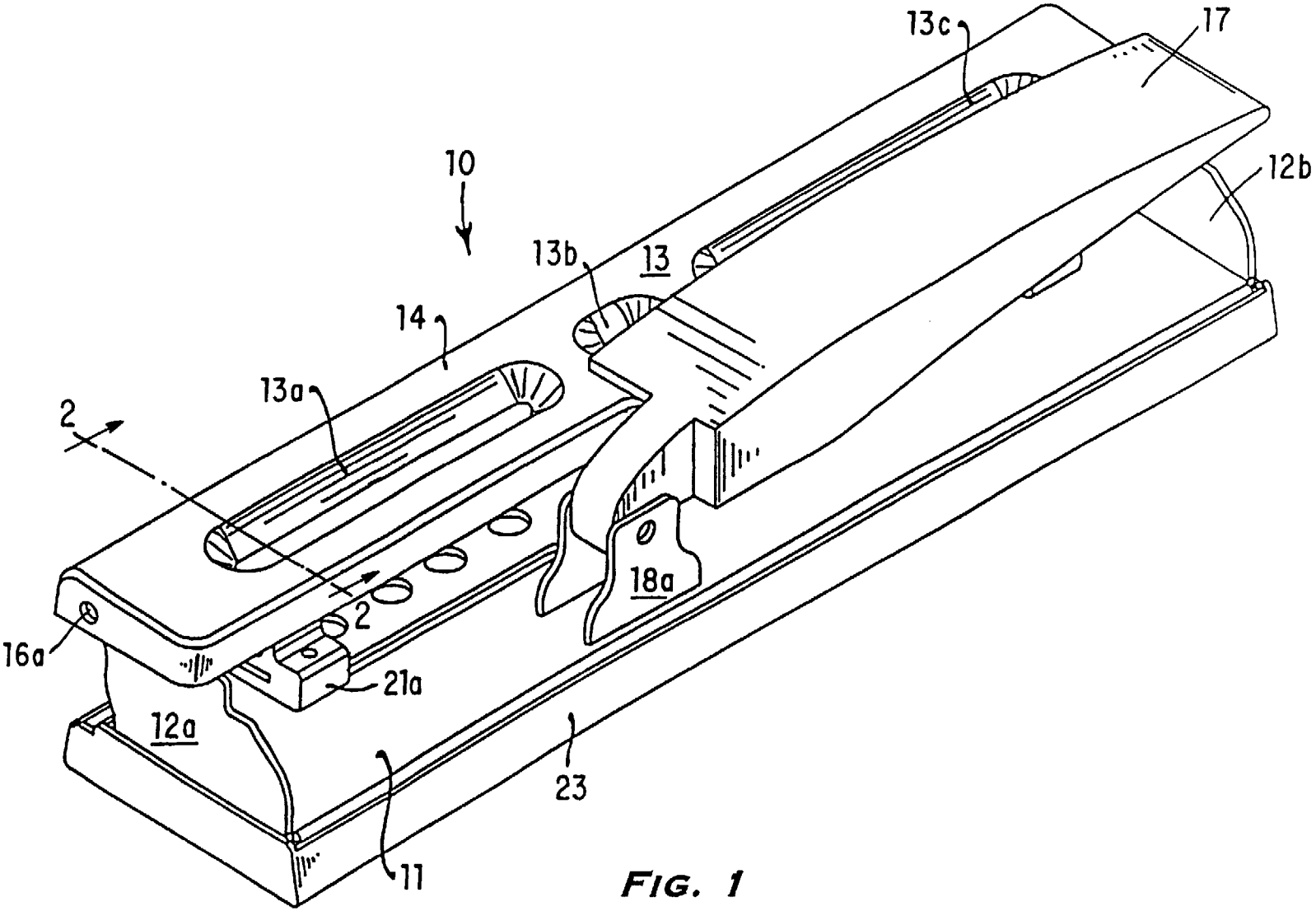
FIG. 1 is a perspective view of the punch of the present invention having a handle and a lever.

In FIGS. 1–4, punch 10 includes base 11, end uprights 12*a*, 12*b*, handle 14 including upper planar surface 13, handle depressions 13*a*, 13*b*, 13*c* mounted for pivoting around pivot pins 16*a*, 16*b* on end uprights 12*a*, 12*b*. Lever 17 is pivotally mounted on brackets 18*a*, 18*b*. Also shown are punch assembly heads 21*a*, 21*b*, 21*c* and slipper 23 mounted on base rails 11*a*, 11*b*. Punch assembly heads 21*a*–*c* include punch pins P and curled projections 34*a*–*c* which reside in groove 40 to prevent turning of punch assembly heads 21*a*–*c* as they are translated (see also FIG. 7).

Figure 2:
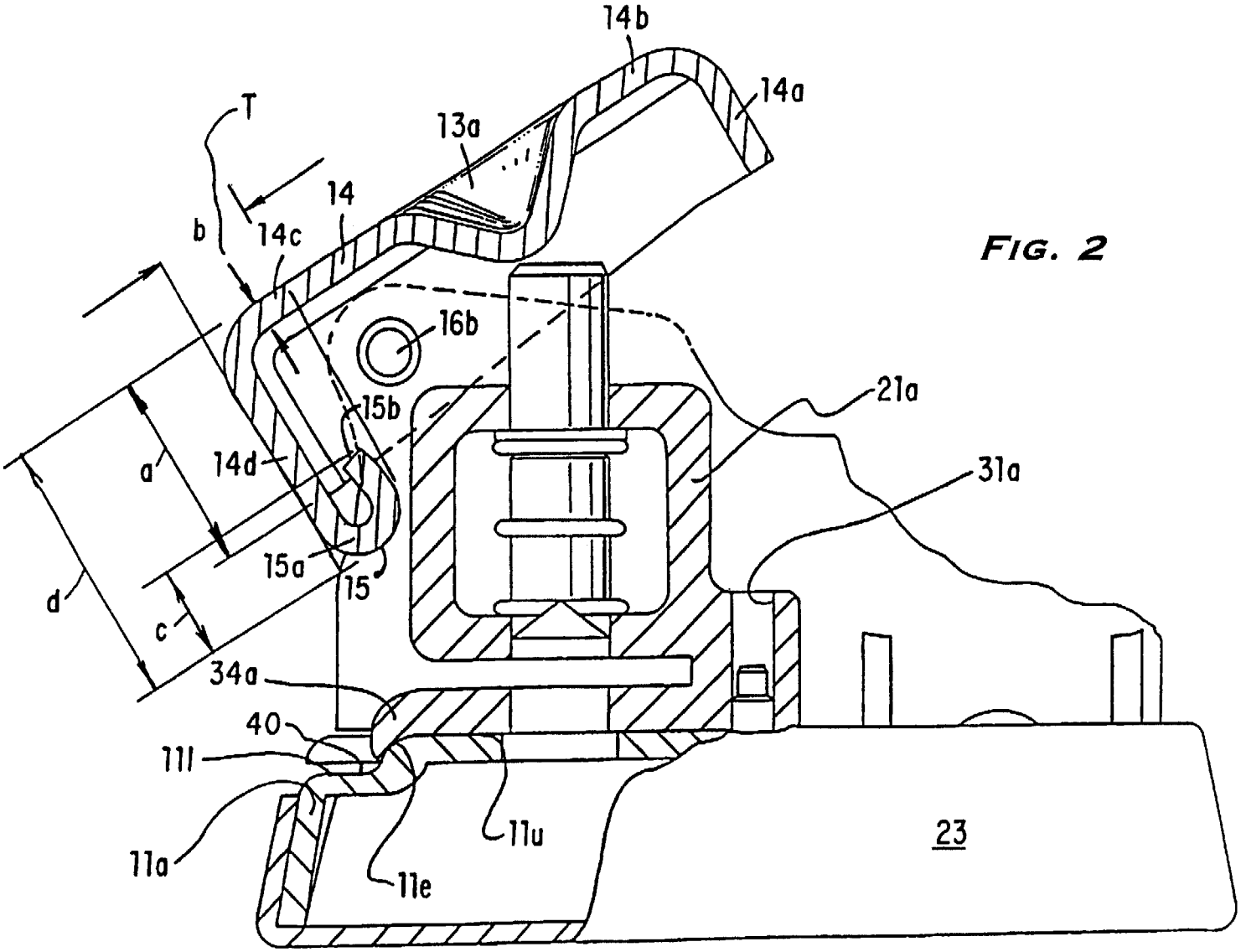
FIG. 2 is a sectional view taken along line 2—2 of FIG. 1 showing the flap handle's reverse curl.
Figure 3:
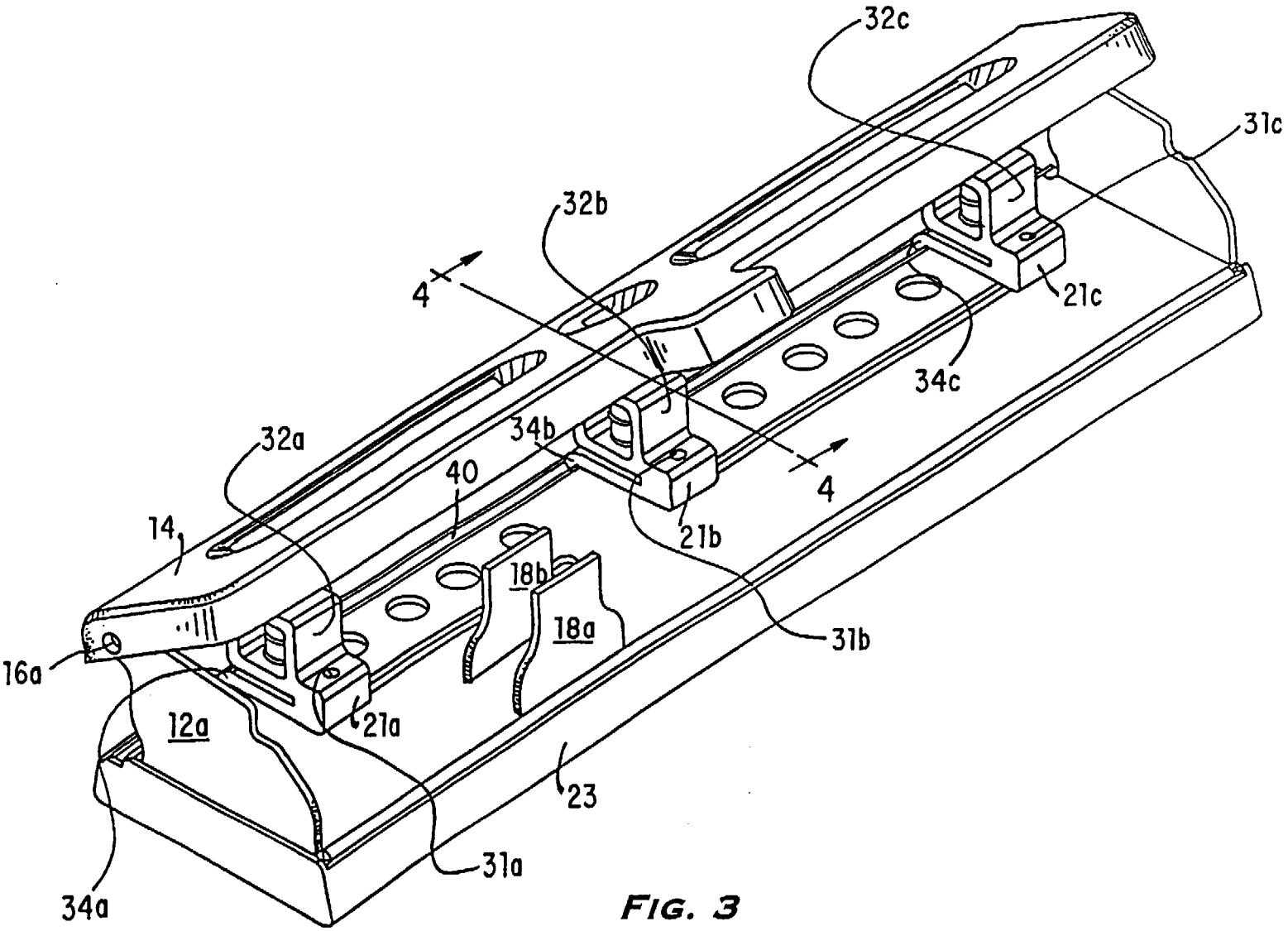
FIG. 3 is a perspective view of the punch with lever removed.

Turning in particular to FIG. 2, handle 14 is formed of a sheet metal and comprises remote flange portion 14*a* substantially perpendicular to upper planar surface 13, (remote from pivot pins 16*a*, 16*b*); remote planar portion 14*b*, handle depression 13*a*, near planar portion 14*c*; near flange portion 14*d* perpendicular to upper planar surface 13 and reverse curl portion 15. Reverse curl portion 15 functions to stiffen and otherwise strengthen handle 14 and includes arc portion 15*a* and upright lip portion 15*b*.

The sheet metal of handle 14 has thickness T. Table 1 below outlines ranges of handle 14 portions in relationship to thickness T.

TABLE 1

| Portion(s) | Dimension | Range |
|---|---|---|
| 1. Near flange portion | a | 6T–8T |
| 2. Curl portion width | b | 2.5T–4T |
| 3. Curl portion depth | c | 2.5T–4T |
| 4. Near flange portion plus depth of curl portion | d | 9T–11T |

Figure 4:
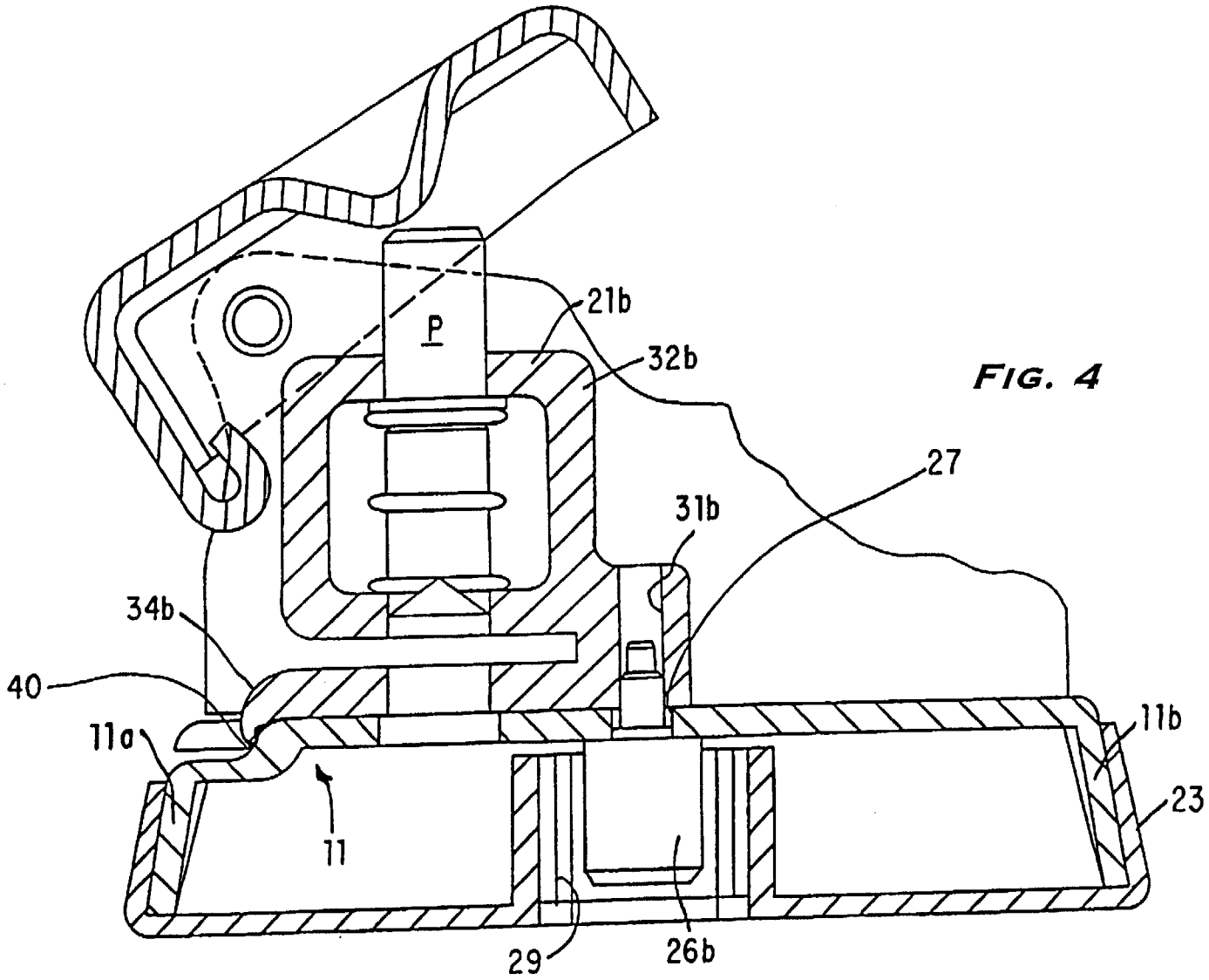
FIG. 4 is a sectional view along line 4—4 of FIG. 3.
Figure 5:
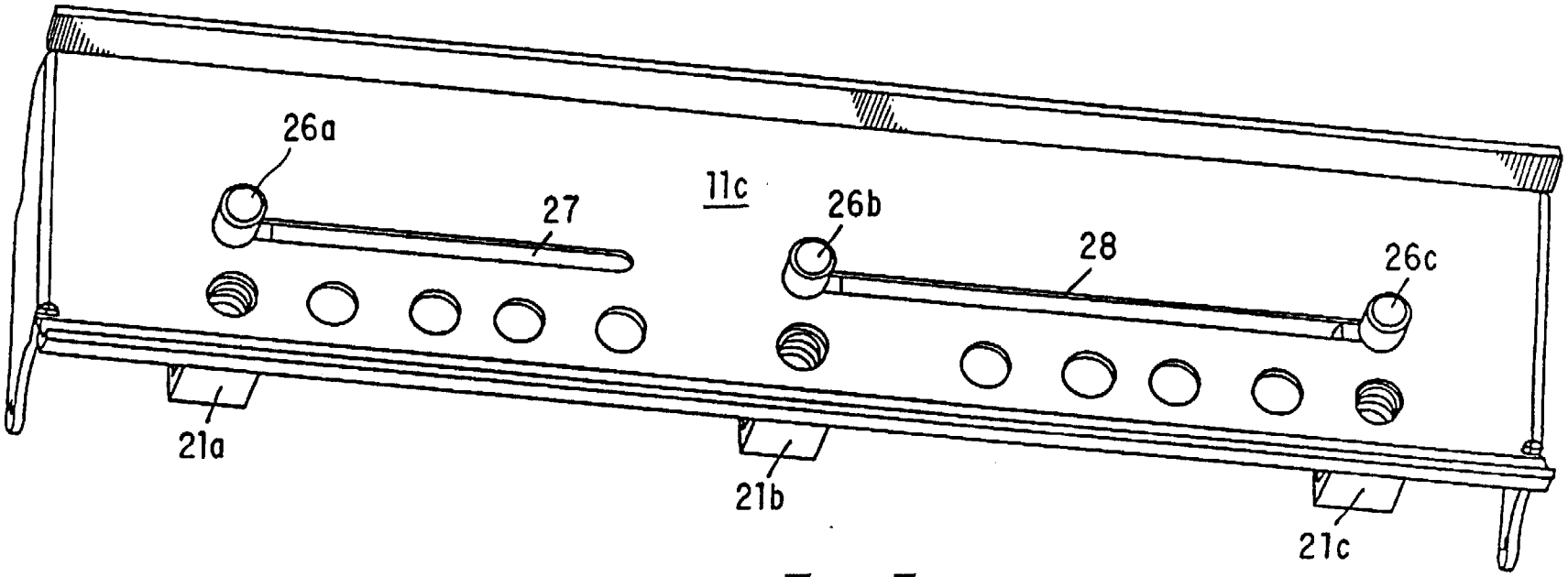
FIG. 5 is a bottom perspective view of the punch with slipper removed.
Figure 6:
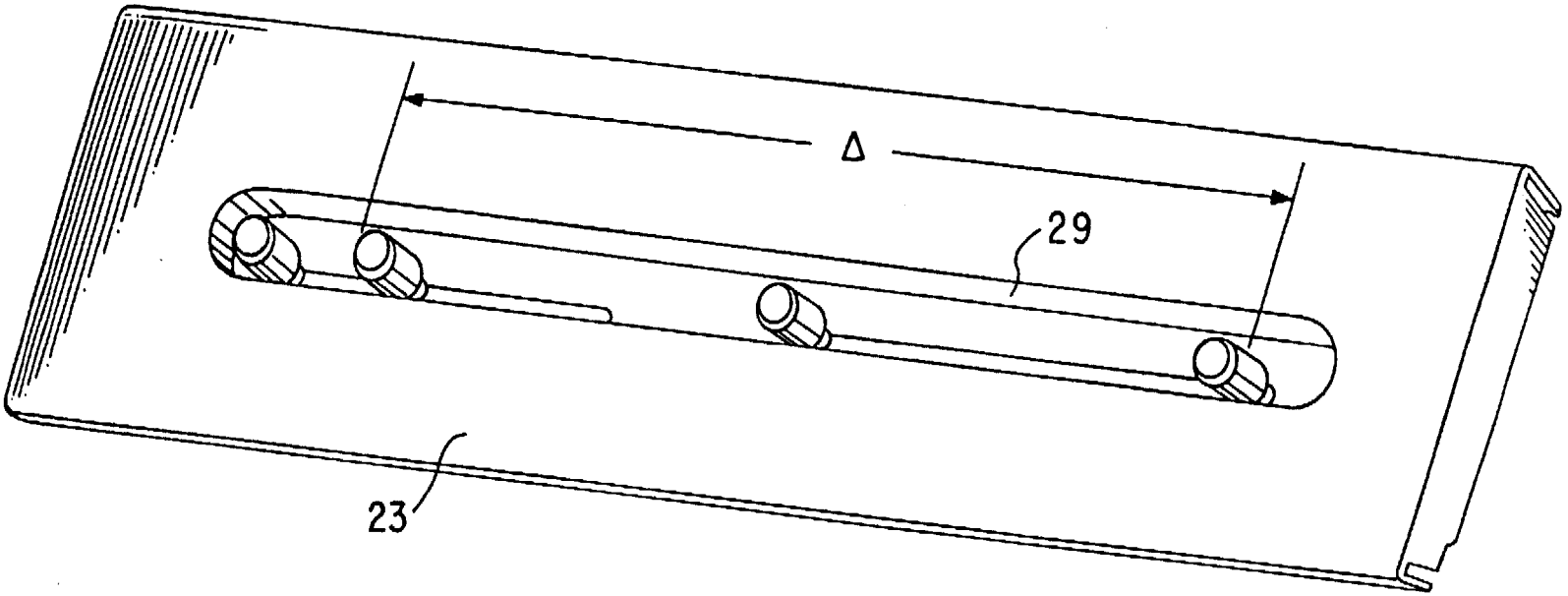
FIG. 6 is a partial perspective bottom view of the punch with the slipper installed.

Turning to FIGS. 4–8, it is seen that punch assembly heads 21*a*, 21*b* and 21*c* are adjustable using retaining screws 26*a*, 26*b* and 26*c* which travel in adjustment slots 27, 28 (FIG. 5) while the curled projections 34*a*–*c* travel in the longitudinal groove 40. Groove 40 is a longitudinal area below upper base surface 11*u* and above a lower base surface 111. Curled projections 34*a*–*c* extend beyond and below upper base surface 11*u* which permits the curled projections 34*a*–*c* to move back and forth in groove 40 during adjustment of the punch assembly heads and while preventing rotation of the heads 21*a*–*c* during their loosening. If a punch assembly head 21*a*–*c* attempts to rotate, its curled projection 34*a*–*c* will engage base edge lie to prevent such rotation. Curled projections 34*a*–*c* may be of other shapes but a curved curled shape is preferred. The retaining screws 26*a*–*c* are threadedly engaged in threaded housing openings 31*a*, 31*b* and 31*c* (FIG. 4). Punch pin P is shown in FIG. 4. Base bottom 11*c* is shown in FIG. 5. Slipper 23 has a center opening 29 to permit access to the retaining screws 26*a*–*c* without removing the slipper 23.

Figure 7:
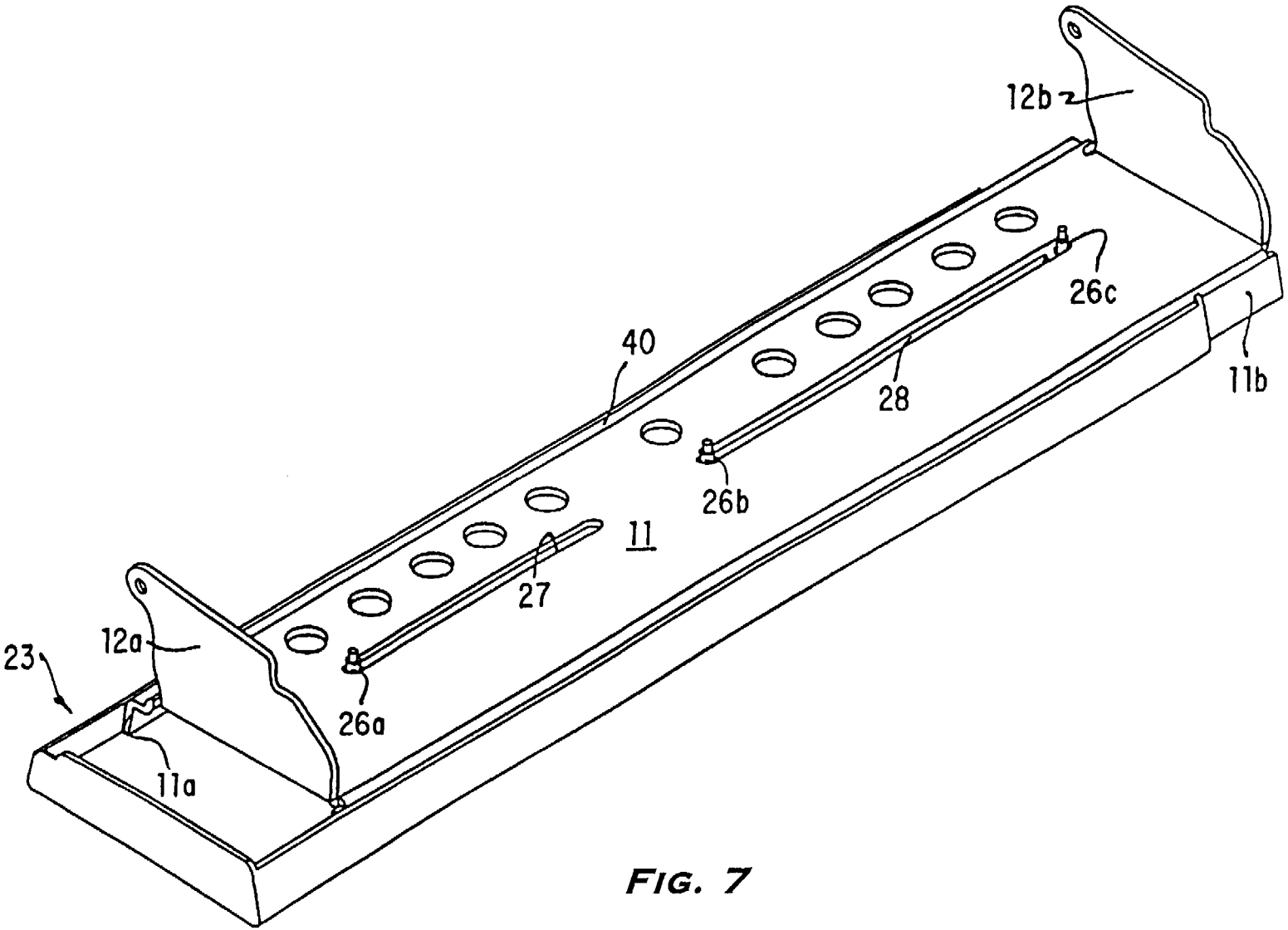
FIG. 7 is a top perspective View of the base with the slipper extended for emptying.

FIG. 7 shows the slipper 23 slid open for emptying and further shows the base rail 11*a*, 11*b*, end uprights 12*a*, 12*b*, slots 27, 28, retaining screws 26*a*–*c*, and groove 40.

Figure 8:
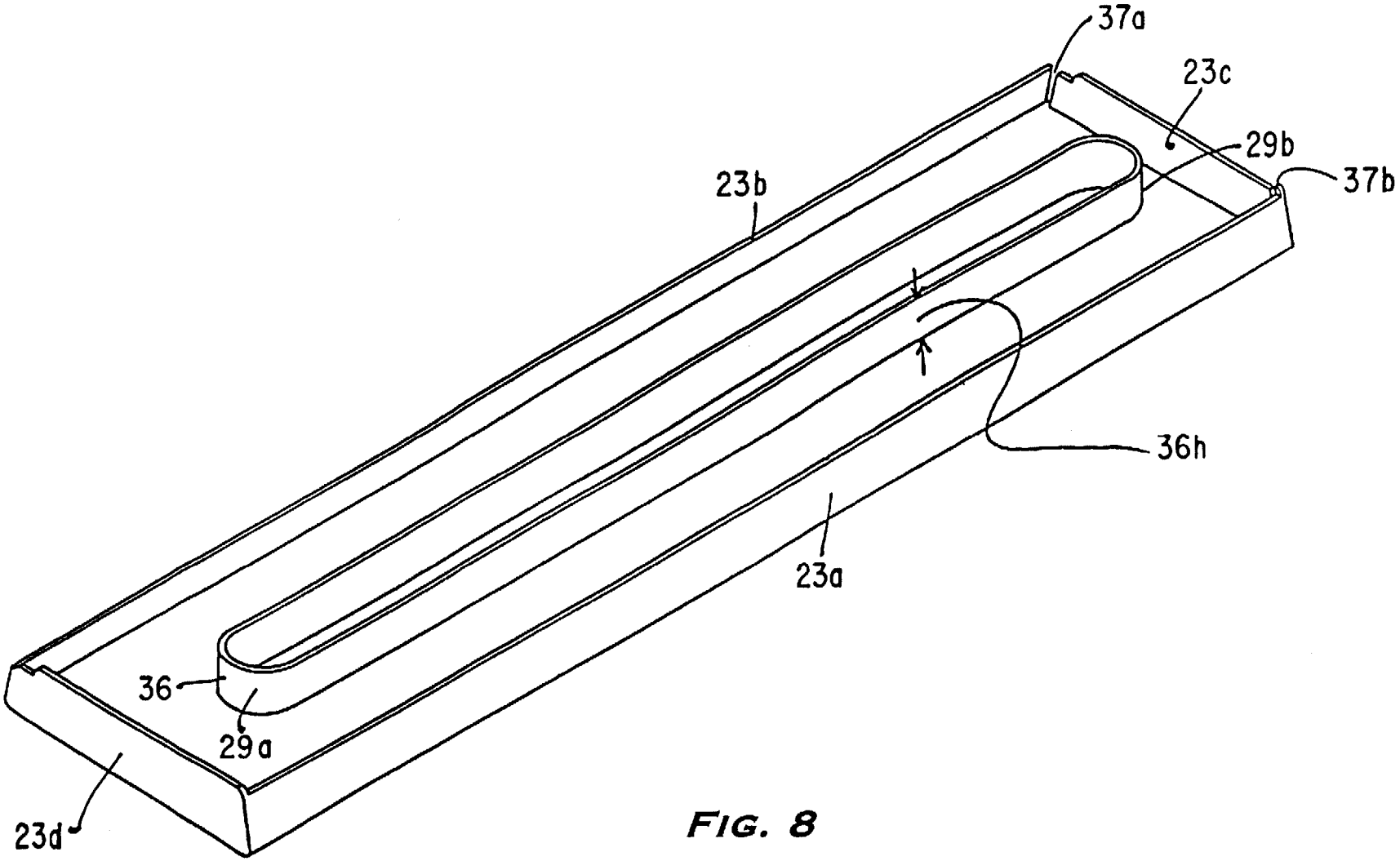
FIG. 8 is a top perspective view of the slipper.

In FIG. 8, the slipper's center opening 29 is bounded by cowling 36 having ends 29*a*, 29*b* which cowling 36 has a height 36*h* sufficient to nearly abut the base bottom 11*c* to prevent paper punch outs or chips from escaping and exiting through center opening 29. Also shown are slipper flanges 23*a*, 23*b* and slipper slotted end 23*c*, and slipper closed end 23*d*. Slots 37*a*, 37*b* permit the slipper 23 to be slid open without removal from the base rails 11*a*, 11*b*. When slipper 23 is slid open, end 29*b* of the cowling 36 engages retaining screw 26*c*, which functions as stop means, to limit its travel. Center opening 29 is longer than the distance (D) between outside retaining screws 26*a* and 26*c* to permit sliding of the slipper 23 relative to the base 11. The length of the opening 29 is less than the overall length of the slipper 23 so that paper punch outs which are all deposited on one side of cowling 36 can migrate past ends 29*a*, 29*b* to the other side as punch 10 is handled and manipulated.

Figure 9:
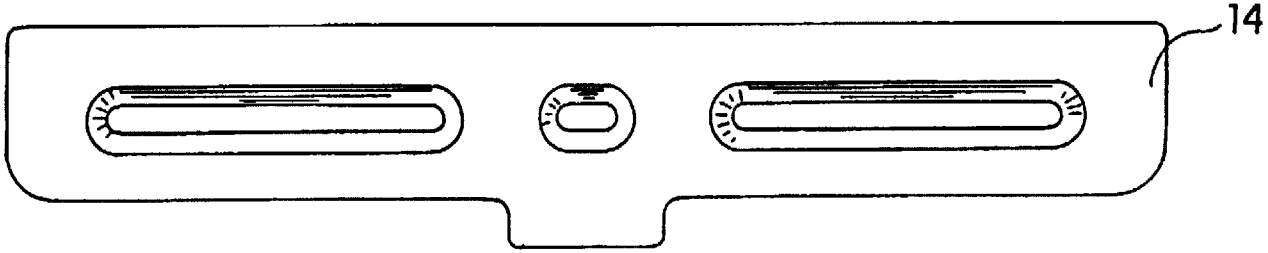
FIG. 9 is a plan view of the flap handle.
Figure 10:
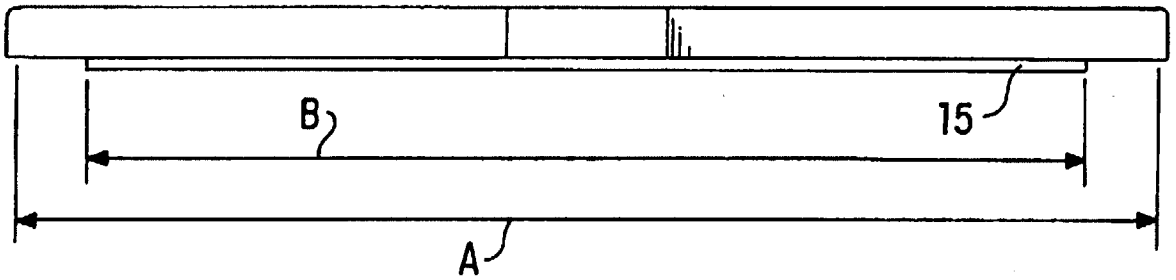
FIG. 10 is an elevational view of the handle viewed from the reverse curl edge.

Finally in FIGS. 9 and 10, the reverse curl portion 15 of handle 14 has a length B which is less than the overall length A of handle 14. Preferably, length B is at least 60% of length A.

We claim:

1. A hand operated punch comprising:

a) a base having an elongated length with an upper surface and a bottom facing opposite said upper surface;

b) at least one elongated slot passing through the base from the upper surface to the bottom of said base and extending along the length of said base;

c) a plurality of adjustable punch assembly heads slidably mounted on the upper surface of said base and selectively positionable along said at least one slot;

d) a slipper slidably positioned on said base in covering relation to said bottom of said base; and e) an elongated opening extending through said slipper and aligned with and exposing said slot, whereby the punch assembly heads are adjustable with the slipper on said base.

2. The punch of claim 1 in which at least one of said punch assembly heads includes stop means for limiting sliding movement of said slipper on said base.

3. A hand-operated punch comprising:

a) a base having an elongated length and an upper surface, a bottom, an outer periphery, and at least one slot passing through said base from said upper surface to said bottom and extending along the length of said base;

b) a plurality of punch heads slidably mounted on the upper surface of said base for movement along a path extending parallel to said slot and to selected locations on said base;

c) adjustment means connected to each of said heads for adjusting the positioning of the heads along said path, said adjusting means extending through said slot and accessible from said bottom of said base; and d) a slipper positioned on the base in covering relations to said bottom, said slipper having a slipper opening extending through said slipper and aligned with said slot to permit access to said adjustment means.

4. The punch of claim 3 wherein the slipper includes:

a) a slipper bottom with an outer periphery corresponding to the outer periphery of said base;

b) upstanding flanges extending along said outer periphery of said slipper bottom for positioning said slipper on said base with the slipper bottom spaced from said bottom of said base;

c) a cowling disposed around said slipper opening and extending upwardly from said slipper bottom to define a chamber between said cowling and said upstanding flanges, said cowling extending upwardly to a height sufficiently near said bottom of said base to isolate said slipper opening from said chamber.

5. The punch of claim 4 wherein:

a) the slipper is slidably mounted on said base for sliding movement along said path;

b) said adjustment means extend into said slipper opening and into the path of movement of said cowling so as to be engaged thereby to limit the sliding movement of said slipper.

6. The punch of claim 5 wherein:

a) each of said adjustment means includes a retaining screw threadably engaged in a threaded opening in one of said heads.

* * * * *